US005443565A

United States Patent [19]

Strange, Jr.

[11] Patent Number: 5,443,565

[45] Date of Patent: Aug. 22, 1995

[54] DRILL BIT WITH FORWARD SWEEP CUTTING ELEMENTS

[76] Inventor: William S. Strange, Jr., P.O. Box 1298, Waskom, Tex. 75692

[21] Appl. No.: 272,559

[22] Filed: Jul. 11, 1994

[51] Int. Cl.[6] ..... E21B 10/46

[52] U.S. Cl. ..... 175/431; 175/432

[58] Field of Search ..... 175/415, 430, 431, 432, 175/403, 405.1

[56] References Cited

U.S. PATENT DOCUMENTS 4,942,933 7/1990 Barr et al. ..... 175/432 X

FOREIGN PATENT DOCUMENTS 2115460 9/1983 United Kingdom ..... 175/431

OTHER PUBLICATIONS

Hycalog Brochure-DS71H Bit-1993.

*Primary Examiner*—William P. Neuder

*Attorney, Agent, or Firm*—John M. Harrison

[57] ABSTRACT

A drill bit characterized by a body fitted with multiple, spaced blades having a forward sweep relative to the center of the bit and cutting elements embedded in the blades at a selected back rake and side rake. In a preferred embodiment the cutting elements are cylindrical and are shaped to define first and second bevelled cutting edges disposed at selected bevel angles with respect to the sides of the cutting elements. The cutting elements are strategically located in the respective blades in desired forward sweep, back rake and side rake configurations to facilitate optimum cutting efficiency and channelling of drilling fluid pumped through the drill bit around the blades and cutting elements to clear the cutting elements of formation cuttings in an optimum manner.

16 Claims, 1 Drawing Sheet

DRILL BIT WITH FORWARD SWEEP CUTTING ELEMENTS

BACKGROUND OF THE INVENTION

1. Field of the Invention

This invention relates to drill bits for drilling oil and gas wells and more particularly, to polycrystalline diamond compact (PDC) drill bits, including core bits, which are provided with projecting, spaced, curved blades oriented in a forward sweep or curvature with respect to the center of the bit, such that cylindrical cutting elements mounted in the blades cut the drilling interval and divert and channel the flow of drilling fluid in an optimum manner. In a most preferred embodiment the cylindrical cutting elements are embedded in the blades at a selected back rake and side rake and are each shaped to define a dual bevelled cutting edge disposed at selected bevelled angles with respect to the sides of the respective cutting elements. The forward sweep of the respective blades and cutting elements and the carefully selected back rake and side rake and dual bevel of the cutting elements at the cutting edge area facilitate optimum cutting efficiency, as well as superior channelling of well fluid pumped through the drill bit across the blades and cutting elements and through the annulus between the drill bit and the down-hole interval.

2. Description of the Prior Art

Drill bits, including core bits, have long been constructed of a molded and fixed matrix body fitted with projecting, spaced blades having cutting elements embedded therein in spaced, offset relationship to optimize cutting efficiency. The cutting elements of PDC drill bits are typically cylindrical in shape, constructed of an extremely hard and tough material such as carbide and industrial grade diamonds and are mounted in the blades at selected positions to facilitate optimum cutting of the interval as the blade rotates under pressure supplied by the weight of the drill string to which the bit is connected. The cutting elements are embedded in each of the blades in staggered relationship to facilitate a uniform wear pattern for all cutting elements, a factor which contributes to longer bit life. Furthermore, the cutting elements are designed to stabilize the bit down-hole and minimize vibration during the drilling operation. Another desired feature of such bits is "whirl resistance" and uniform distribution or channelling of drilling fluid which is pumped through the drill stem and bit, past the cutting elements and blade and up through the annulus between the bit and the down-hole interval. A typical line of PDC drill bits is distributed by Hycalog, of Denver, Colo., and includes a molded, fired matrix body having spaced blades provided with embedded industrial grade diamond cutting elements.

One of the problems inherent in conventional drill bits and PDC bits in particular, is the lack of facility for efficiently channeling the drilling fluid flowing from the end of the bits across the blades and cutting elements in the proper direction and "sweep" to substantially clean the cutting elements of cuttings from the drilling interval. Accordingly, under circumstances where the cuttings are not substantially scoured from the cutting elements as the cutting elements cut into the drilling interval, the efficiency of the cutting elements during the drilling operation is reduced and drilling time is lengthened. Another problem with conventional drill bits is the less than optimum cutting efficiency presented when embedding the cutting elements in blades that are substantially vertically oriented with respect to the longitudinal axis of the drill bit body and have no forward sweep in the direction of bit rotation, measured from the center of the bit, and are embedded in the blades at an inefficient back rake and side rake angle, or no such angular mounting at all.

Accordingly, it is an object of this invention to provide a new and improved drill bit which is characterized by multiple, spaced blades having a forward sweep or curvature in the direction of drill rotation measured from the center of the bit and fitted with multiple cylindrical cutting elements arranged in an optimum cutting configuration.

Another object of this invention is to provide a PDC drill bit characterized by multiple, spaced blades embedded with cylindrical cutting elements, each having a shaped cutting edge perimeter characterized by a dual angle cutting configuration and seated at a selected back rake and side rake, to optimize cutting efficiency.

A still further object of this invention is to provide a new and improved PDC drill bit which is characterized by multiple, spaced blades each having a forward sweep in the direction of bit rotation extending from the center of the bit and fitted with cutting elements embedded therein in an optimum back rake and side rake cutting arrangement, which cutting elements are each shaped with a dual bevel and bevel angle configuration at the cutting edges for optimum cutting efficiency as the bit rotates.

SUMMARY OF THE INVENTION

These and other objects of the invention are provided in a new and improved PDC drill bit, including a core bit, which is characterized by a molded, fixed bit body fitted with outwardly-extending, spaced, curved blades each having a forward sweep or curvature in the direction of bit rotation extending from the center of the bit and fitted with multiple cylindrical cutting elements, each having a cutting face disposed at a selected back rake and side rake and, in a most preferred embodiment, each cutting edge of the respective cutting elements provided with a dual bevelled configuration to optimize cutting efficiency, reduce drilling time and minimize premature drilling wear and breaking of the cutting elements.

BRIEF DESCRIPTION OF THE DRAWING

The invention will be better understood by reference to the accompanying drawing, wherein.

DESCRIPTION OF THE PREFERRED EMBODIMENTS

Figure 1:
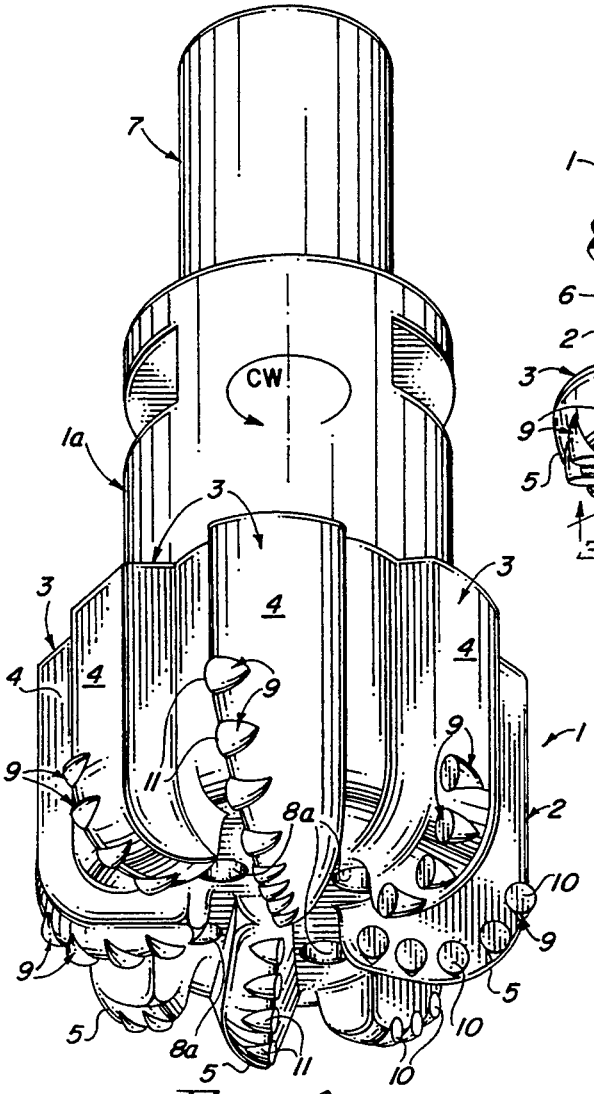
FIG. 1 is a perspective view of a preferred embodiment of the drill bit of this invention.
Figure 2:
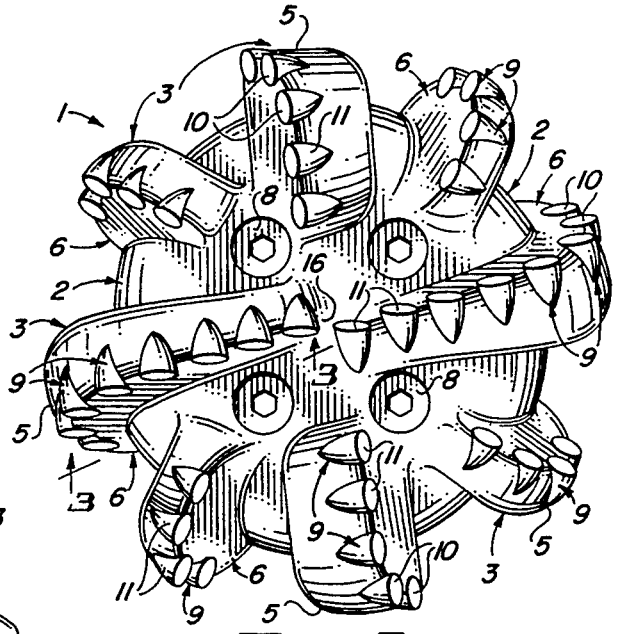
FIG. 2 is an end view of the blades and cutting elements in the drill bit illustrated in FIG. 1.

Referring initially to FIGS. 1 and 2 of the drawing, a preferred embodiment of the drill bit of this invention is generally illustrated by reference numeral 1. The drill bit 1 is characterized by a molded and fired matrix bit body 2, with multiple blades 3 extending from the bit body 2 in a forward curvature or sweep with respect to the center 16 of the bit body 2, toward the direction of rotation, as further illustrated in FIG. 2. The bit body 2 extends from a drill bit collar la which is, in turn, mounted on a bit stem 7 connected to a drilling string (not illustrated) in conventional manner. Each of the blades 3 is characterized by a blade base 4 which projects from the bit body 2 substantially parallel to the longitudinal axis of the drill bit collar la and the adjacent blades 3 and extends downwardly, where it curves inwardly to define a blade crown 5 and simultaneously outwardly in a blade sweep 6, that terminates near the center 16 of the bit body 2, as further illustrated in FIG. 2. It will be appreciated from a further consideration of FIG. 2 that the blade sweep 6 in each of the blades 3 is curved in the direction of bit rotation from the center 16, to facilitate mounting multiple cutting elements 9 therein in a selected offset and back rake and side rake angular configuration, as hereinafter described. As further illustrated in FIGS. 1–3 and 5, each of the cutting elements 9 is characterized by a flat cutting face 10 bounded by a circular cutting edge 11, with that portion or arc of the cutting edge 11 which extends farthest outwardly of the blade crown 5 of each of the blades 3, initially contacting and cutting a downhole interval (not illustrated) when the drill bit 1 is rotated by a drill string (not illustrated) in cutting configuration. In a most preferred embodiment of the invention and referring again to FIG. 5 of the drawing, the cutting face 10 of each of the cutting elements 9 is altered and shaped by providing a first bevel 12 extending at a first bevel angle 13 with respect to the longitudinal axis of the cutting element 9 and a second bevel 14 extending from the end of the first bevel 12 at a second bevel angle 15, also measured with respect to the longitudinal axis of the cutting element 9, respectively. It has surprisingly been found that providing each of the cutting elements 9 with the first bevel 12 and the second bevel 14 at least along the arc of contact with the downhole interval, minimizes splitting, chipping and cracking of the cutting elements 9 during the drilling process and therefore not only increases drilling efficiency, but also enhances both cutting element and bit life. This combination of features further decreases drilling time and therefore saves money during the drilling operation.

Figure 3:
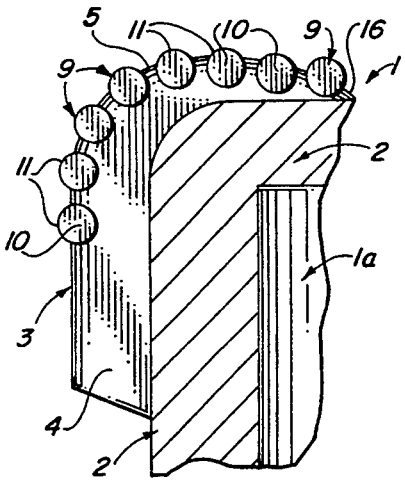
FIG. 3 is a sectional view taken along line 3—3 of the drill bit illustrated in FIG. 2, more particularly illustrating a preferred cutting element arrangement and orientation.
Figure 5:
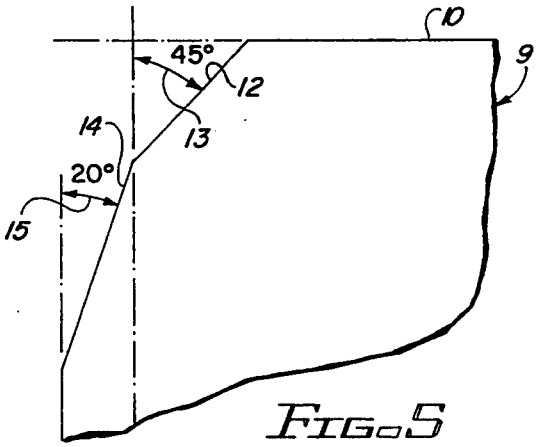
FIG. 5 is a side sectional view of the cutting edge of a typical cutting element, more particularly illustrating a preferred dual bevel design for optimizing cutting efficiency and prolonging cutting element life.

Referring again to FIGS. 1–3 of the drawing, as heretofore described, each of the cylindrical cutting elements 9 is seated or embedded in a corresponding blade 3 in a selected sequence and staggered relationship for optimum cutting efficiency. Moreover, the cutting elements 9 are embedded in the respective blades 3 in order to create a desired back rake, or angle with respect to the longitudinal axis of the bit body 2, in the range of from about 8 degrees to about 30 degrees, and most preferably, about 20 degrees, throughout the entire length or span of the blades 3 from the blade base 4 around the blade crown 5 and throughout the blade sweep 6, to the center 16 of the bit body 2, as illustrated in FIG. 2. Moreover, from approximately the blade crown 5, a side rake, also in the range of from about 8 degrees to about 30 degrees, and most preferably, about 20 degrees, with respect to a plane which is normal or perpendicular to the longitudinal axis of the bit body 2, is provided in the orientation of the cutting elements 9, as illustrated in FIG. 3. Accordingly, referring now to FIG. 3 of the drawing, in a most preferred embodiment of the invention the back rake and side rake of the cutting face 10 of each cutting element 9 is as follows: The back rake and side rake of the first two cutting elements 9 at the blade base 4 extending upwardly toward the blade crown 5 are each about 20 degrees. The back rake and side rake, respectively, of the remaining cutting faces 10 of the respective cutting elements 9 extending around the crown 5 are as follows: 20 degrees and 15 degrees; 20 degrees and 10 degrees; 20 degrees and 5 degrees; and 20 degrees and no side rake for the last three cutting elements 9, respectively. This combination of angular embedment of the respective cutting elements 9 to create both a back rake and a side rake, along with the blade sweep 6 of each of the blades 3 and, in a most preferred embodiment, the provision of a first bevel 12 and a second bevel 14 in the cutting elements 9 as illustrated in FIG. 5, operate to create a drill bit 1 which minimizes cutting element wear, maximizes cutting efficiency and thus optimizes the performance of the drill bit 1. Furthermore, referring again to FIGS. 1 and 2 of the drawing, the forward blade sweep 6 of the blades 3 as illustrated, causes fluid flowing from the interior of the drill bit 1 from openings (not illustrated) closed by the cap screws 8, downwardly along the contour of the blade sweep 6. The fluid is caused to swirl against each of the cutting elements 9 arranged in a line along the blades 3 from the blade base 4 to the blade sweep 6 and remove interval cuttings jammed between the cutting elements 9 as the drill bit 1 rotates. This sweeping and clearing function is very important to clear the cutting elements 9 and helps maintain cooling and optimum cutting efficiency in the drill bit 1. Since this drilling fluid is forced from the drill bit 1 at high velocity, the sweeping and swirling action from the swirling drilling fluid or mud exerts a tremendous force against these cuttings and since the cutting elements 9 are arranged in a forward sweep or curvature as illustrated, they are more easily removed and all of the cutting elements 9 are contacted by the drilling fluid.

Figure 4:
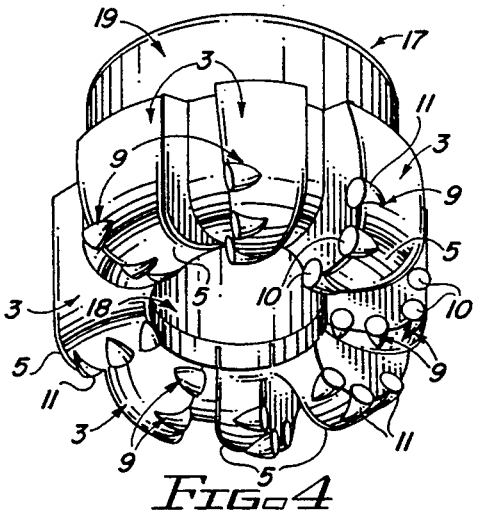
FIG. 4 ms a perspective view of a core bit designed with the same cutting element configuration as the drill bit illustrated in FIG. 1.

Referring now to FIG. 4 of the drawing, in another preferred embodiment of the invention the core bit 17 is also fitted with multiple cutting elements 9 arranged in a forward sweep direction and in a selected side rake and back rake, as in the case of the drill bit 1 illustrated in FIGS. 1–3. The core bit 17 is fitted with a conventional core opening 18 and is mounted on a core bit collar 19, also in the same manner as the drill bit 1.

It will be appreciated by those skilled in the art that the drill bit 1 and core bit 17 of this invention are characterized by a high degree of efficiency and optimum drilling characteristics because of the forward curvature of the blades 3 to create the blade sweep 6 extending from the center 16 of the bit body 2 to the blade base 4, respectively, in each of the blades 3, along with arrangement of the respective cutting elements 9 in a desired back rake and side rake orientation across the blade crown 5 of the blades 3 and further in view of the shaping of each of the cutting elements 9 to create the first bevel 12 and second bevel 14 as illustrated in FIG. 5 and heretofore described.

While the preferred embodiments of the invention have been described above, it will be recognized and understood that various modification may be made therein and the appended claims are intended to cover all such modifications which may fall within the spirit and scope of the invention.

Having described my invention with the particularity set forth above, what is claimed is:

1. A drill bit for attachment to a drill string, rotation with the drill string and drilling through earth formations, said drill bit comprising a bit body attached to the drill string, said bit body having a center, a crown encircling said center and a rounded side extending from said crown; a plurality of blade means shaped in said bit body, said blade means curving from substantially said center of said bit body around said crown of said bit body and to said side of said bit body in the direction of bit rotation; and a plurality of cutting elements fixedly carried by said blade means for engaging and cutting the earth formations responsive to rotation of the drill string and said drill bit.

2. The drill bit of claim 1 wherein said cutting elements each comprise a generally cylindrically-shaped cutting element body having a substantially flat cutting face bounded by a cutting edge for engaging and cutting the earth formation.

3. The drill bit of claim 2 comprising at least one bevel shaped in said cutting edge of said cutting element.

4. The drill bit of claim 3 wherein said at least one blade bevel comprises two blade bevels in said cutting edge and extending between said cutting face and said cutting element body.

5. The drill bit of claim 1 comprising a first bevel shaped in said cutting edge at said cutting face and a second bevel shaped in said cutting edge between said first bevel and said cutting element body.

6. The drill bit of claim 5 wherein said first bevel describes an angle of about 45 degrees with respect to said cutting face and said cutting element body and said second bevel describes an angle of about 20 degrees with respect to said cutting face and said cutting element body.

7. The drill bit of claim 1 wherein said cutting face of said cutting element is disposed at a back rake in the range of from about 8 degrees to about 30 degrees with respect to the longitudinal axis of said bit body.

8. The drill bit of claim 1 wherein said cutting face of said cutting element is disposed at a side rake in the range of from about 10 degrees to about 30 degrees with respect to a plane extending transverse to the longitudinal axis of said bit body.

9. The drill bit of claim 1 wherein:

(a) said cutting face of said cutting element is disposed at a back rake in the range of from about 8 degrees to about 30 degrees with respect to the longitudinal axis of said bit body; and (b) said cutting element is disposed at a side rake in the range of from about 10 degrees to about 30 degrees with respect to a plane extending transverse to the longitudinal axis of said bit body.

10. The drill bit of claim 9 wherein said back rake is about 20 degrees and said side rake is about 20 degrees.

11. The drill bit of claim 9 wherein said cutting elements each comprise a generally cylindrical cutting element body having a substantially flat cutting face bounded by a cutting edge for engaging and cutting the earth formation.

12. The drill bit of claim 11 comprising at least one bevel shaped in said cutting edge of said cutting element.

13. The drill bit of claim 12 wherein said at least one bevel comprises a first bevel shaped in said cutting edge at said cutting face and a second bevel shaped in said cutting edge between said first bevel and said cutting element body.

14. The drill bit of claim 13 wherein said first bevel describes an angle of about 45 degrees with respect to said cutting face and said cutting element body and said second bevel describes an angle of about 20 degrees with respect to said cutting face and said cutting element body.

15. A drill bit for attachment to a drill string, rotation with the drill string and drilling through earth formations, said drill bit comprising a generally cylindrical bit body attached to the drill string, said bit body having a center, a crown encircling said center and a rounded side extending from said crown; a plurality of curved blades shaped in said bit body, in spaced relationship with respect to each other, said blades curving from substantially said center of said bit body around said crown of said bit body and to said side of said bit body in the direction of bit rotation; and a plurality of generally cylindrical cutting elements embedded in said blade means at a selected back rake and side rake, for engaging and cutting the earth formations responsive to rotation of the drill string and said drill bit.

16. A drill bit for attachment to a drill string, rotation with the drill string and drilling through earth formations, said drill bit comprising a generally cylindrical bit body attached to the drill string, said bit body having a center, a crown encircling said center and a rounded side extending from said crown; a plurality of curved blades shaped in said bit body, in spaced relationship with respect to each other, said blades curving from substantially said center of said bit body around said crown of said bit body and to said side of said bit body in the direction of bit rotation; a plurality of generally cylindrical cutting elements embedded in said blade means at a selected back rake and side rake, said cutting elements each comprising a bevelled cutting edge for engaging and cutting the earth formations responsive to rotation of the drill string and said drill bit.

* * * * *